US007380704B1

(12) United States Patent
Nizan et al.

(10) Patent No.: US 7,380,704 B1
(45) Date of Patent: Jun. 3, 2008

(54) MAILBOX SYSTEM

(76) Inventors: Ran Nizan, 109 Boulevard Dr., Danbury, CT (US) 06810; Efrat Nizan, 109 Boulevard Dr., Danbury, CT (US) 06810

( * ) Notice: Subject to any disclaimer, the term of this patent is extended or adjusted under 35 U.S.C. 154(b) by 0 days.

(21) Appl. No.: 11/615,775

(22) Filed: Dec. 22, 2006

Related U.S. Application Data

(60) Provisional application No. 60/754,016, filed on Dec. 24, 2005.

(51) Int. Cl.
*A47G 29/12* (2006.01)

(52) U.S. Cl. ..... 232/38; 232/17

(58) Field of Classification Search ..... 232/38, 232/17, 39, 45; D99/29; 220/6
See application file for complete search history.

(56) References Cited

U.S. PATENT DOCUMENTS 2,934,389 A * 4/1960 Krey ..... 312/262
3,005,378 A * 10/1961 Golden ..... 359/474
4,160,520 A * 7/1979 Cluthe ..... 232/17
4,275,829 A * 6/1981 Johnson et al. ..... 232/17
4,872,610 A * 10/1989 Grabowiecki ..... 232/17
5,253,763 A * 10/1993 Kirkley et al. ..... 206/600
5,346,125 A * 9/1994 Critzer, Sr. ..... 232/17
5,575,422 A * 11/1996 Peterman ..... 232/38
5,626,317 A * 5/1997 Altman ..... 248/121
5,862,931 A * 1/1999 Cox et al. ..... 220/6
6,729,535 B2 * 5/2004 Lackey et al. ..... 232/17
6,817,080 B1 * 11/2004 Lanyon et al. ..... 29/455.1
7,048,177 B1 * 5/2006 Franklin ..... 232/17
7,182,244 B2 * 2/2007 Brown ..... 232/38
2006/0191929 A1 * 8/2006 Berg et al. ..... 220/6

* cited by examiner

*Primary Examiner*—William L. Miller
(74) *Attorney, Agent, or Firm*—Milde & Hoffberg LLP

(57) ABSTRACT

A curbside mailbox kit, compliant with 39 U.S.C. 111 (Feb. 8, 2001), comprising: a base, two sides, an optional signaling flag, a roof, a rear side, and a front door, wherein the mailbox kit is provided in an unassembled form having a void cross section substantially less than 30 square inches, and having a void cross section when assembled of at least 30 square inches. A mailbox, comprising a base, hinged front panel, rear panel, two side panels, and a top, each of the two side panels being attached to the base by a hinge. A mailbox kit, comprising two planar sides, a planar base, a planar rear panel, a hinged planar front door, and a top, the sides, base, rear panel and front being provided in a package with their respective planes parallel, the kit being adapted to be assembled into a box.

18 Claims, 6 Drawing Sheets

BUILD-IT YOURSELF MAIL BOX

SIDE VIEW

BUILD-IT YOURSELF MAIL BOX

FRONT VIEW

BUILD-IT YOURSELF MAIL BOX

SIDE VIEW

MAILBOX SYSTEM

BACKGROUND OF THE INVENTION

1. Field of the Invention

The present invention relates to design and construction of curbside contemporary mailboxes.

2. Applicable Regulations and Prior Art

The US Postal Service has issued 39 CFR Part 111 expressly incorporated herein by reference, which, among other things, governs curbside mailboxes. See also, Domestic Mail Manual DO41, (DMM Issue 58 Updated Jan. 6, 2005), and USPS-STD-7B (Feb. 8, 2001, Fed. Register 66(27) 9509-9522), expressly incorporated herein by reference in their entirety.

Contemporary mailboxes provide increased manufacturing flexibility over traditional domed designs, but as a whole the differences have been most aesthetic. A particular issue in traditional and most contemporary mailbox designs is that they are distributed in a state ready for use, and thus have a large void volume as delivered. This makes shipping inefficient and forces retailers to allocate a large amount of shelf and warehouse space to mailboxes, leading to high distribution costs.

According to USPS DMM DO41, the local postmaster may approve a curbside mailbox constructed by a customer who, for aesthetic or other reasons, does not want to use an approved manufactured box. The custom-built box must generally meet the same standards as approved manufactured boxes for flag, size, strength, and quality of construction.

Every curbside mailbox should bear the following address information: (a) A box number, if used, inscribed in contrasting color in neat letters and numerals at least 1 inch high on the side of the box visible to the carrier's regular approach, or on the door if boxes are grouped; (b) A house number if street names and house numbers have been assigned by local authorities, and the postmaster authorizes their use as a postal address. If the box is on a different street from the customer's residence, the street name and house number must be inscribed on the box; and (c) Optionally, the mailbox may bear the owner's name.

No advertising on a mailbox or its support is permitted.

The post or other support for a curbside mailbox must be neat and of adequate strength and size. The post may not represent effigies or caricatures that tend to disparage or ridicule any person. The box may be attached to a fixed or movable arm.

A mailbox with a lock must have a slot that is large enough to accommodate the customer's normal daily mail volume. The USPS neither opens a locked box nor accepts a key for this purpose.

Mailboxes must meet regulations and requirements as stipulated by USPS collection and delivery, operation and policy. This includes carrier door operation, flag operation (full service mailboxes), in-coming mail openings and the retrieval of out-going mail. The opening style, design and size are determined by the manufacturer, however, the carrier must be able to deposit the customer's mail. Outgoing mail of all designs must be able to be pulled straight out of the mailbox without interference from protrusions, hardware, etc. Mailboxes must not be made of any transparent, toxic, or flammable material. The mailbox must protect mail from potential water damage that may result from wet weather conditions. A rear door is permitted to enable the customer to remove mail without standing in the street.

Mailbox designs that do not conform to the dome-rectangular shape of Traditional designs but meet specified capacity requirements are classified as Contemporary. In addition, Contemporary designs have limits on maximum dimensions. Although the shape and design is less restrictive, Contemporary mailboxes must meet the same applicable functional requirements as traditional mailboxes.

Mailbox designs that provide security for customer's in-coming mail are classified as Locked mailboxes. Although the shape and design is less restrictive, Locked mailboxes must meet the same applicable functional requirements. Designs having a slot for in-coming mail must be at least 1.75 inches high by 10 inches wide. If a slot has a protective flap it must operate inward to ensure mail can be inserted in a horizontal manner without requiring any additional effort of carriers. The slot must be positioned on the front side of the mailbox facing the street. In addition, the slot must be clearly visible and directly accessible by mail carriers. Any designs, which allow for out-going mail, must meet all applicable requirements of this standard.

Locked mailbox designs may allow for both in-coming and out-going mail. It is preferred by the USPS that both in-coming and out-going mail compartments be located behind a single carrier service door. Alternate positioning of the in-coming mail compartment such as beneath or side-by-side with the out-going compartment is permitted provided that no additional carrier service is introduced.

Decorative art and devices can be attached to the exterior of approved mailbox designs provided they do not interfere with mail delivery or present a safety hazard. Devices can also be mounted in the interior of approved mailboxes provided they do not cause the intended mailbox to fail a minimum capacity test and do not interfere with mail delivery or present a safety hazard. Any advertising on a mailbox or its support is prohibited. Unrestricted spring-loaded devices and designs are prohibited. Auxiliary flags or devices used to signal the customer that the mail has arrived must operate automatically without requiring additional carrier effort.

Ferrous or nonferrous metal, wood (restrictions apply), plastic, or other materials may be used, as long as their thickness, form, mechanical properties, and chemical properties adequately meet the operational, structural, and performance requirements set forth in 39 C.F.R. 111. Materials used must not be toxic, flammable or transparent. The entire bottom area of all mailboxes where mail would rest should be fabricated to prevent mail from damage due to condensation or moisture. Except for the internal mail compartment of locked style mailboxes, all designs must not present a lip or protrusion that would prevent the mail from being inserted or pulled straight out of the mailbox. The surface of the floor cannot be made of wood material. The floor should be ribbed or dimpled, embossed, or otherwise fabricated provided the resulting surface area (touching mail) does not exceed 0.25 square inch (per dimple/impression) and is a minimum of 0.12 inch high on centers not exceeding 1 inch. A mat insert having a raised surface contour may be used for the internal mail compartment of locked style mailboxes only.

The Carrier Signal Flag of a full service mailbox cannot be made of wood, and plastic is the material preferred by the USPS. Likewise, the door handle cannot be made of wood, and plastic is material preferred by the USPS.

There should be only one carrier service door which provides access for mail delivery and collection intended by the unit. The carrier service door should operate freely and solely by pulling outward and downward with a convenient handle or knob. The design of the door, including hinges and handles must provide protection against wind, rain, sleet, or snow. Door latches must hold the door closed but allow easy opening and closing requiring no more than 5 pounds of force. Action of the latch must be a positive mechanical one not relying solely on friction of the hinge parts. The door should not be spring-loaded. Magnetic latches are acceptable provided adequate closure power is maintained under various environmental conditions. It is preferred by the USPS that by either tactile or by sound (i.e. "snap" or "click") carriers are alerted that door is properly shut. The door, once opened, should remain in the open position until the carrier pushes it closed. The door should rotate a minimum of 100 degrees when opened and it is preferred by the USPS that the maximum rotation be limited to 120 degrees or less. When in a fully opened and rest position, the opening angle of the door should not measure more than 180 degrees. No protrusions other than the handle/knob, door catch, alternate flag design, decorative features or markings are permitted on the carrier service door. Protrusions of any kind that reduce the usable volume within the mailbox when closed are unacceptable.

The handle or knob should have adequate accessibility to permit quickly grasping and pulling it with one hand (with or without gloves) to open the door. The handle or knob should be located within the top ⅓ of the door. Acceptable designs allow sufficient finger clearance and surface area for carriers to grasp.

Mailboxes may have a rear door, provided that it does not interfere with the normal delivery and collection operation provided by the carrier or require the carrier to perform any unusual operations. The rear door must not be susceptible to being forced open as a result of large mail items such as newspapers and parcels being inserted through the carrier door.

Locked mailbox designs should have an effective means to ensure that in-coming mail is only accessible by the customer. The use of locks on Contemporary and Traditional mailbox designs is prohibited, that is, locked designs have significant design limitations. Traditional, Contemporary, and Locked mailbox designs classified as Full Service have a carrier signal flag. The flag design is limited by USPS regulation. The flag must be mounted on the right side when facing the mailbox from the front. The flag must not require a lift or more than 2 pounds of force to retract. Additionally, when actuated (signaling out-going mail) the flag should remain in position until retracted by the carrier. The operating mechanism of the flag should not require lubrication and should continue to operate properly and positively (without binding or excessive free play). Optionally, the flag may incorporate a self-lowering feature that causes it to automatically retract when the carrier service door is opened provided no additional effort is required of the carrier. The self-lowering feature cannot present protrusions or attachments and must not interfere with delivery operations in any manner or present hazardous features.

The mailbox must bear two inscriptions on the carrier service door: "U.S. MAIL" in a minimum of 0.50 inch high letters and "Approved By The Postmaster General" in a minimum of 0.18 inch high letters. These inscriptions may be positioned beneath the in-coming mail slot for Limited Service Locked Mailboxes. Markings should be permanent and may be accomplished by applying a decal, embossing on sheet metal, raised lettering on plastic, engraving on wood or other methods that are suitable for that particular unit. The manufacturer's name, address, date of manufacture (month and year), and model number or nomenclature must be legible and permanently marked or affixed on a panel (rear, backside of door, bottom or side interior near the carrier service door) of the mailbox that is readily accessible and not obscured.

The choice of coatings and finishes is optional, provided that applicable requirements are met. All coatings and finishes should be free from flaking, peeling, cracking, crazing, blushing, and powdery surfaces. Coatings and finishes must be compatible with the mailbox materials. Accept for small decorative accents, mirror-like coatings or finishes are prohibited.

The mailbox may be any color. The carrier signal flag can be any color except any shade of green, brown, white, yellow or blue. The preferred flag color is fluorescent orange. Also, the flag color should present a clear contrast with predominant color of the mailbox.

The mailbox is provided with means for convenient and secure mounting. The manufacturer may offer various types of mounting accessories such as a bracket, post or stand.

A receptacle for the delivery of newspapers may be attached to the post of a curbside mailbox provided no part of the receptacle interferes with the delivery of mail, obstructs the view of the flag, or presents a hazard to the carrier or the carrier's vehicle. The receptacle must not extend beyond the front of the box when the door is closed. No advertising may be displayed on the outside of the receptacle, except the name of the publication.

The mailbox should be properly assembled and utilize the best commercial practice workmanship standards in the fabrication of all components and assemblies. That is, the USPS presupposes that the mailbox will be delivered in assembled form, but there appears to be no such requirement, nor that in the event of such a requirement, that no waver will be issued. All movable parts should fit and operate properly with no unintended catch or binding points. The unit should be free from harmful projections or other hazardous devices. The unit should not have any sharp edges, sharp corners, burrs or other features (on any surfaces) that may be hazardous to carriers/customers, or that may interfere with delivery operations.

Traditional and Contemporary designs must meet minimum capacity requirements tested by insertion and removal of a standard test gauge which measures 18.50" long×5.00" wide×6.00" high. The test gauge is inserted with its 6.00" dimension aligned in the vertical axis (perpendicular to the mailbox floor). The gauge must be capable of easy insertion and removal; and while inserted, allow for the door(s) to be completely closed without interference. The capacity of Locked designs, which have slots, chutes or similar features, will be tested and approved based upon whether standard USPS mail sizes (see Table I) can be easily inserted through the mail slot or opening. Retrieval of this mail from the locked compartment shall be equally as easy.

Carrier service doors, auxiliary doors, door catches/mechanisms, carrier signal flags and applicable accessory devices should be capable of operating 7,500 normal operating cycles (1 cycle=open/close) at room temperature, continuously and correctly, without any failures such as breakage of parts. Testing may be performed either manually or by means of an automated mechanically driven test fixture which essentially mimics a manual operation. This test is applicable to all mailbox designs.

A number of environmental and performance tests are also applicable to mailboxes.

See, U.S. Pat. Nos. 6,817,080 (especially FIG. 3); 6,739,732; 5,346,125; 5,119,986; 1,292,050; 4,413,770; 1,483, 077; 3,706,411; and 4,275,829, each of which is expressly incorporated herein by reference.

SUMMARY OF THE INVENTION

The present invention provides a contemporary curbside mailbox design which is collapsed for shipment and after assembly meet all applicable regulations. In particular, a disassembled design would typically be predicted to have certain difficulties meeting the applicable environmental and strength tests.

A particular advantage of the collapsible or disassembled mailbox design is that is consumes only a small amount of space, in particular the void space in the package will be very low. In contrast, preassembled mailboxes typically waste most of the mailbox capacity during shipping and inventory. The present invention also provides relatively simple assembly, to produce a mailbox which is sturdy, protects the mail, and is aesthetically pleasing. The design also accommodates a removable decorating side panel, allowing consumer customization and personalization.

One embodiment of the invention employs a folding side assembly that uses a specially designed hinging system, having tracks, and screws, that allows it to be readily unfolded and secured to an open position. The folding side assembly is formed of six assembled sections, each of which is attached to adjacent sections by means of a series of pivoting hinges of tracks and screws. These six sections form four sides of the box, with a base meeting applicable regulation and providing a suitable means for mounting on a post or cantilever. Two of the side sections preferably comprise decorated or decoratable side panels, and most preferably having a transparent window with a slot for insertion of an artistic or decorative sheet.

Accordingly, it is preferable in this embodiment that the base be hinged to the door, rear and side panels, and the hinges be arranged so that the left and right sides can lie flat on top of each other when collapsed. The consumer then opens the hinged assembly, and rigidizes it, for example with edge strips, which connect the rear and sides at right angles. The front door is freely rotatable about its hinge, and meets applicable postal service regulations. A roof is also provided, which is for example a flat top or "V" shaped top which rigidly connects to the sides and rear, and provides the latching mechanism for the front door. The assembly may be further secured together by screws or other fasteners, and flexible sealing strips or other suitable gasket materials used to provide environmental protection.

In an alternate embodiment, a "V" shaped or flat roof section may be hinged to the sides, with either an open or closed topological configuration, that is, one section is optionally disconnected during storage. In this case, the rear section is locked into place to provide the required rigidity to transform the collapsible structure into a sturdy mailbox.

According to a further embodiment, the mailbox is provided as a set of parts, at least a portion of which fit together by tongue in groove construction techniques. The structure may be locked together by screws, other fasteners, or adhesive. Likewise, the tongue in groove joints may be sealed using a gasket or other means to provide environmental immunity.

For example, the present invention is amenable for form mailboxes in a durable antique brass or antique bronze powder coated finish. These mailboxes provide an antique look that adds elegance to any home. Since the design does not require a solid casting, but rather a set of smaller generally planar parts (except perhaps the roof), costs for such a design are reduced. The joints may be readily hidden, and thus the final product would be indistinguishable on casual observation from a traditional preassembled or single casting design.

The construction and method of operation of the invention, however, together with additional objects and advantages thereof will be best understood from the following description of specific embodiments when read in connection with the accompanying drawings.

BRIEF DESCRIPTION OF THE DRAWINGS

Now, the present invention will be described in detail with reference to the accompanying drawings.

DETAILED DESCRIPTION OF THE PREFERRED EMBODIMENTS

Figure 1:
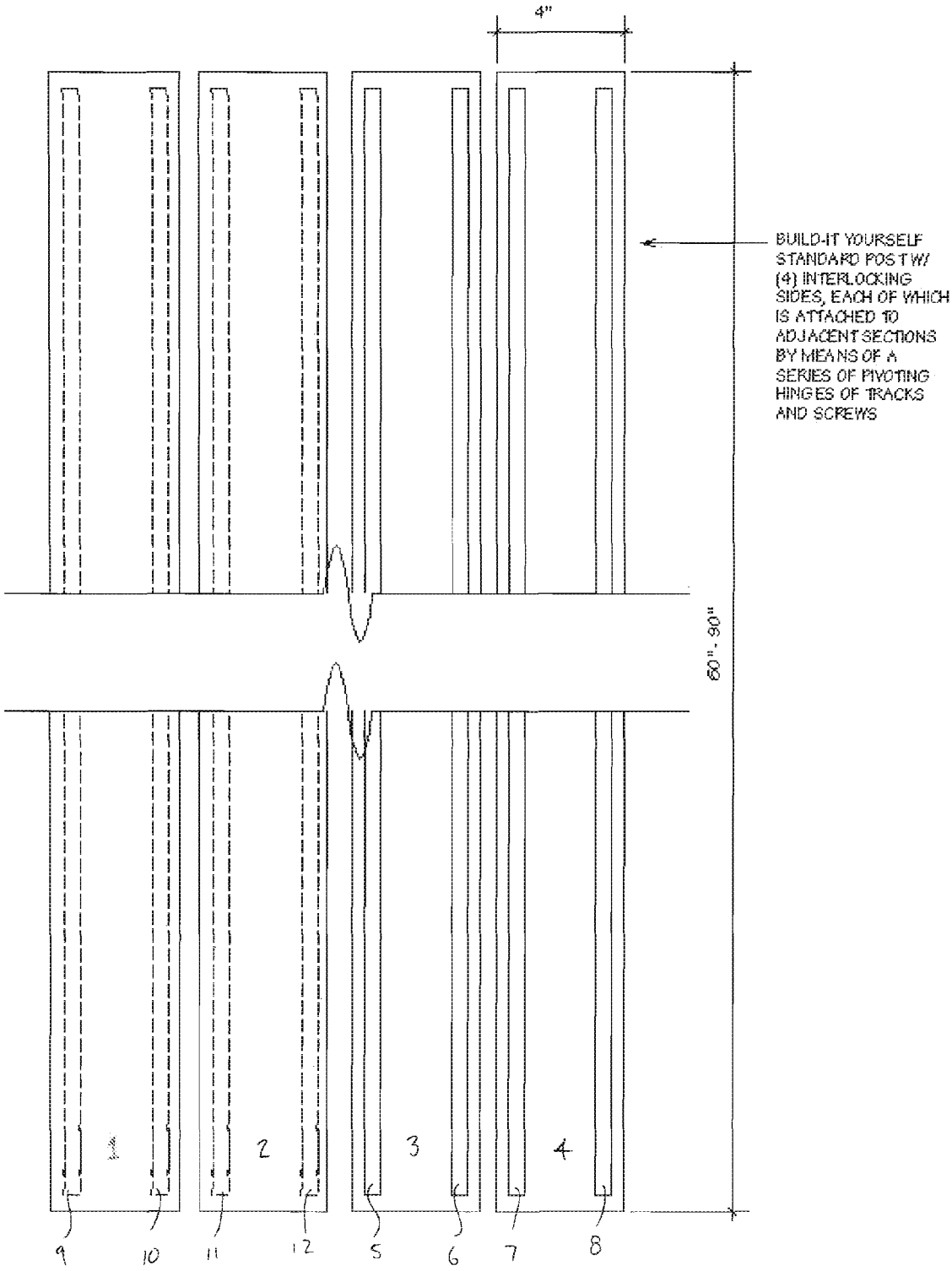
FIG. 1 shows a plan view of a modular post, showing four sides with interlocking sides.

FIG. 1 shows a modular post construction, wherein a hollow post is formed of four shell sections 1, 2, 3, 4, preferably formed of metal. The four sections are, for example, extruded aluminum, held together, for example, by a interlocking sections 5, 6, 7, 8, 9, 10, 11, 12. Alternately, a hinge structure (with optional screws) or trapezoidal tongue in a corresponding groove structure may be provided to connect the faces into a hollow structure. A cap at the top, and an optional stake at the bottom (not shown in FIG. 1), may be used to maintain alignment along the axis of the post.

Figure 2A:
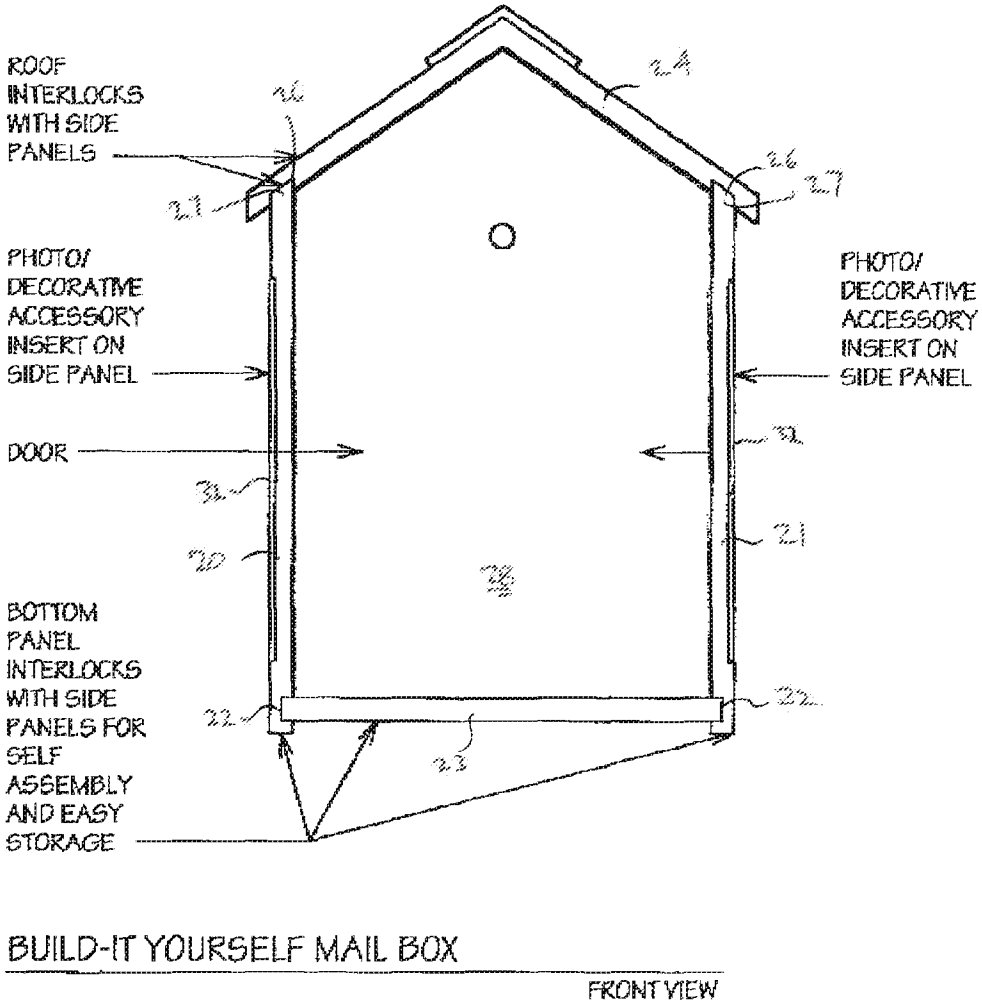
FIGS. 2A-2D, respectively, show front and side views of "V" and "U" shaped roof embodiments of the present invention.
Figure 2B:
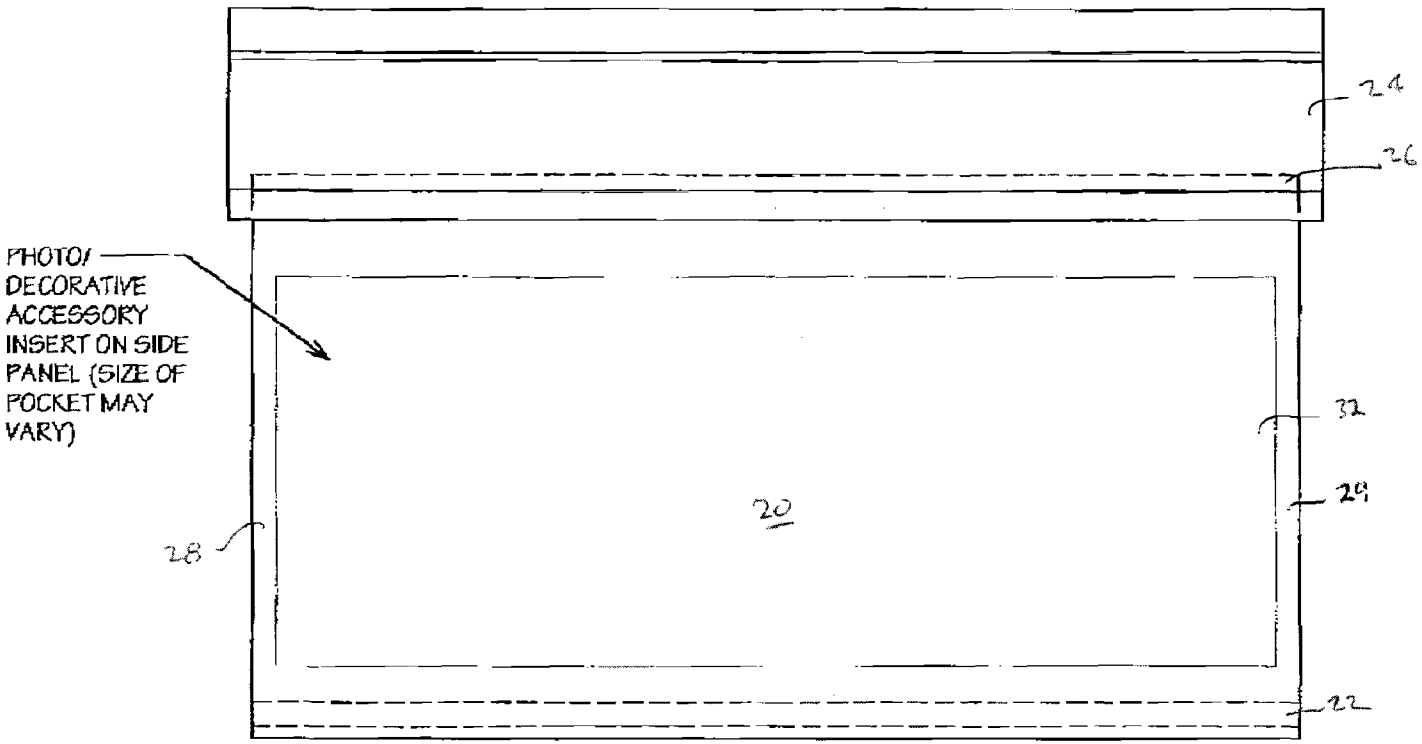
Figure 2C:
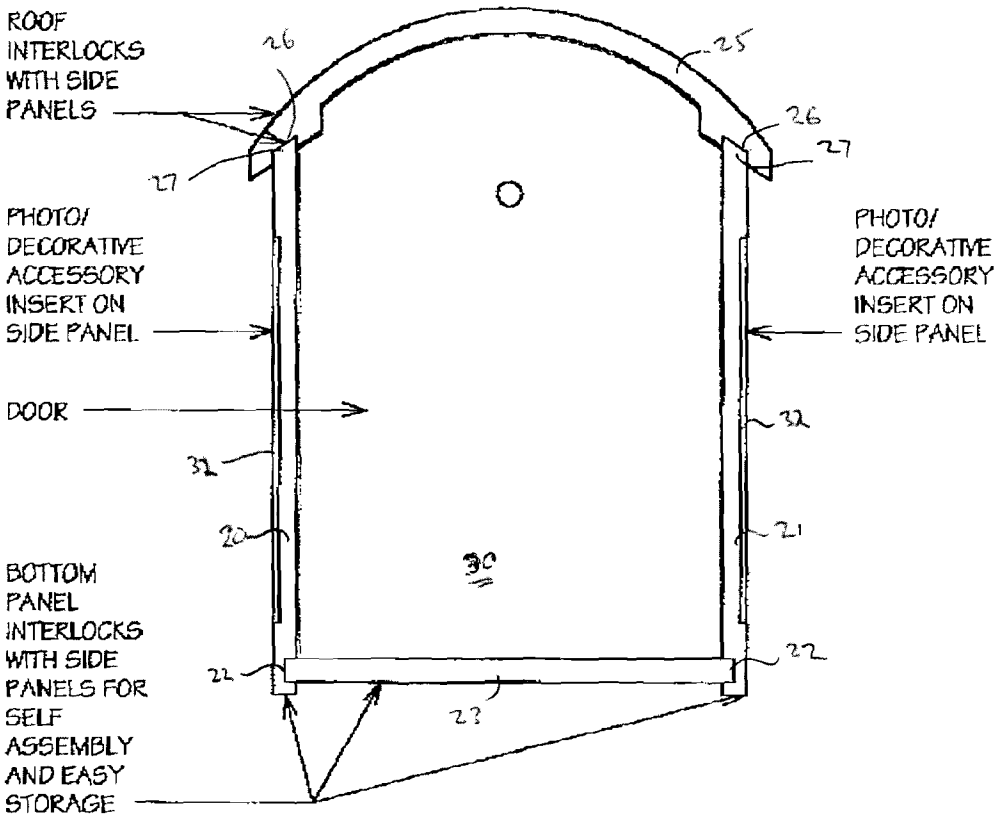
Figure 2D:
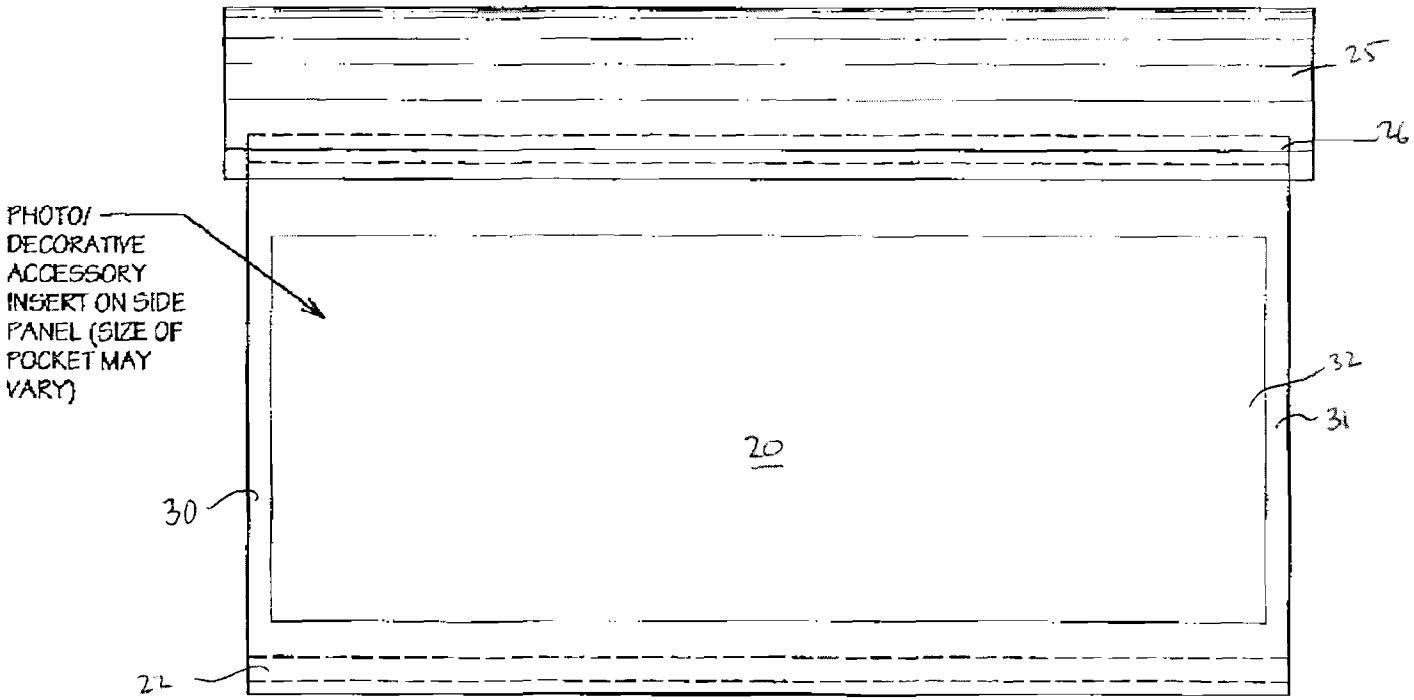

FIGS. 2A and 2B show, respectively, a front and side view, respectively, of an embodiment of the invention with a "V" shaped sloping roof. FIGS. 2C and 2D show, respectively, a front and side view, respectively, of an embodiment of the invention with a "U" shaped curved roof. Each of the sides 20, 21 is provided with a slot 22 for insertion of the base 23. Likewise, the roof 24 ("V" shaped in FIGS. 2A and 2B) or 25 ("U" shaped in FIGS. 2C and 2D) has a pair of slots 26 on its respective sides for insertion of the top edge 27 of the sides 20, 21. A flag (not shown, but of standard type) is provided with a suitable mounting on the right side 20. The rear panel 29, 31 is screwed or otherwise fastened to the base 23, sides 20, 21 and roof 24, 25. The frond door 28, 30 is hinged to the front of the base 23. The sides 20, 21 each have a transparent sheet 32 providing a slot for insertion of a sheet, for example identifying the house number, resident name, and/or to enhance the aesthetic appeal of the mailbox.

One preferred design is made entirely of aluminum, with a ⅛" thick extruded aluminum body (base 23, sides 20, 21, roof 24 or 25) with a ⅛" thick die cast aluminum front door 18 or 30 and rear panel 29, 31. Alternate materials include other aluminum fabrication such as heat treated sheet, molded plastic, laminated fiberglass, copper, stainless steel, galvanized steel, heavy duty 12 gauge steel, or the like. The curbside mailboxes may have a durable powder coated finish available in various colors and, preferably include standards compliant signal flag and a magnetic door latch. The die cast door 28 or 30 may be attached to the base 23 with a full-width stainless steel hinge (not shown) allowing for smooth operation.

Figure 3C:
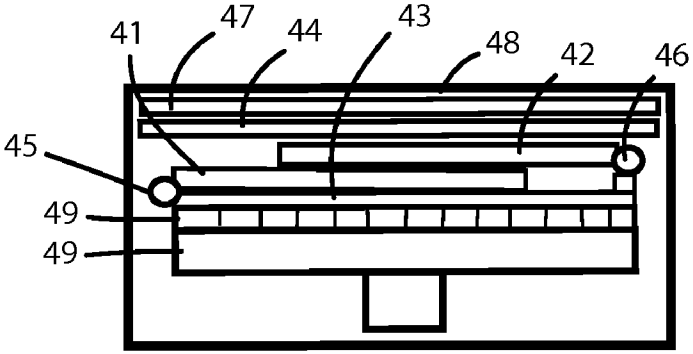
FIG. 3C shows the embodiment of FIGS. 3A and 3B collapsed, in a package.
Figure 3B:
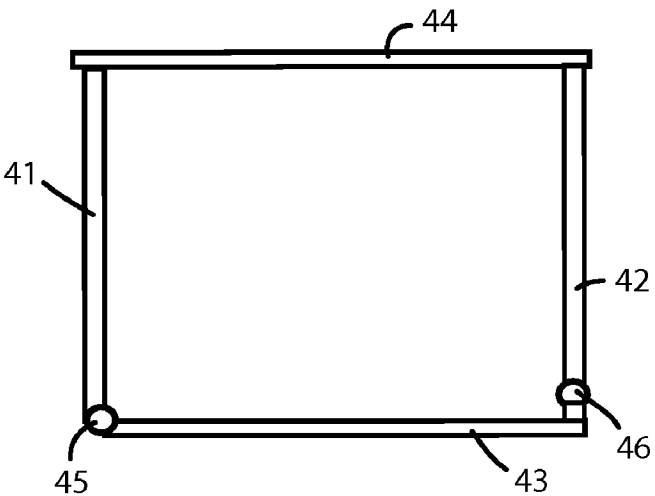
FIGS. 3A and 3B, show respectively a side view and plan cross sectional view of an embodiment of the present invention.
Figure 3A:
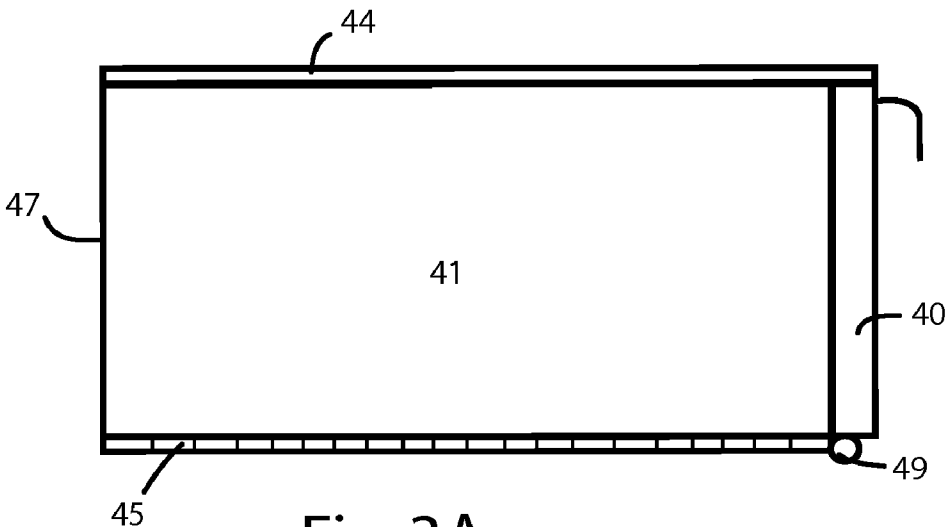

Another embodiment of the invention, shown in FIGS. 3A and 3B, employs side panels 41, 42 which are connected by hinges 45, 46 to a bottom section 43. The front door 40 is also connected by a hinge 49 to the bottom section 43. With the cover 44 and rear panel 47 detached, the side panels 41, 42 and front door 40 can fold down onto the bottom section 43 for efficient packaging within package 48. When packaged, the planes of the sides, base, rear panel and front are parallel.

The mailbox may also have nickel, polished brass, copper, or antique bronze accents.

Preferred dimensions of the mailbox are: 9" high×7" wide×19¾" deep; or 12½" high×9½" wide×22" deep; or 10½" high×8¼" wide×21½" deep.

Although the invention is illustrated and described herein as embodied in the examples, it is nevertheless not intended to be limited to the details shown, since various modifications and structural changes may be made therein without departing from the spirit of the invention and within the scope and range of equivalents of the claims.

What is claimed is:

1. A mailbox kit, comprising two planar sides, a planar base, a planar rear panel, a hinged planar front door, and a top, wherein said two planar sides, said planar base, said planar rear panel, said planar front door are provided with their respective planes parallel together in a common package with said top, said kit being adapted to be assembled into a mailbox, and when assembled, said two planar sides, said planar base, said planar rear panel and said planar front door form said mailbox compliant with 39 C.F.R. 111 (Feb. 8, 2001).

2. The mailbox kit according to claim 1, wherein said mailbox complies with the requirements of Domestic Mail Manual DO41 (DMM Issue 58 Updated Jan. 6, 2005).

3. The mailbox kit according to claim 1, wherein said mailbox is adapted to be approved in accordance with USPS-STD-7B (Feb. 8, 2001, Fed. Register 66(27) 9509-9522).

4. The mailbox kit according to claim 1, further comprising a vertical mounting post having an unassembled state wherein said vertical mounting post comprises a plurality of elongated members which can be moved with respect to each other and an assembled state being adapted to support said mailbox wherein said plurality of elongated members which are interlocked.

5. The mailbox kit according to claim 1, wherein said two planar sides, said planar base, said planar rear panel, and said top are connected, after assembly, by a tongue in groove joint.

6. The mailbox kit according to claim 1, wherein each of said two planar sides, and said hinged planar front door are connected to said planar base by a respective hinge.

7. The mailbox kit according to claim 1, wherein said mailbox has a cross section area when assembled of at least 30 square inches.

8. The mailbox kit according to claim 1, wherein said two planar sides, said planar base, said planar rear panel, said hinged planar front door, and said top are each formed of aluminum.

9. The mailbox kit according to claim 1, wherein at least said two planar sides and said planar base of said mailbox form a collapsible structure, which are collapsed when in said package, and wherein during assembly said planar rear panel is locked into place adjoining said planar base, said two planar sides, and said top, to provide sufficient rigidity of said two planar sides, said top, and said planar base to transform said collapsible structure into said mailbox.

10. The mailbox kit according to claim 1, wherein said top is planar, wherein said two planar sides, said planar base, said planar rear panel, said planar front door, and said planar top are provided in said common package with their respective planes parallel.

11. A method for constructing a mailbox from a mailbox kit, comprising:

providing a kit comprising two planar sides, a planar base, a planar rear panel, a hinged planar front door, and a top, wherein said two planar sides, said planar base, said planar rear panel, said planar front door are provided with their respective planes parallel together in a common package with said top;

positioning said planar rear panel at a rear of said planar base and said two planar sides, mutually perpendicular thereto;

affixing said top above said two planar sides and planar rear panel, to form a mailbox from said kit;

wherein after assembly, said two planar sides, said planar base, said planar rear panel and said planar front door form said mailbox compliant with 39 C.F.R. 111 (Feb. 8, 2001).

12. The method according to claim 11, wherein the assembled mailbox complies with the requirements of Domestic Mail Manual DO41 (DMM Issue 58 Updated Jan. 6, 2005).

13. The method according to claim 11, wherein said mailbox is adapted to be approved in accordance with USPS-STD-7B (Feb. 8, 2001, Fed. Register 66(27) 9509-9522).

14. The method according to claim 11, wherein said two planar sides, said planar base, said planar rear panel, and said top are connected, after assembly, by a tongue in groove joint.

15. The method according to claim 11, wherein each of said two planar sides, and said hinged planar front door are connected to said planar base by a respective hinge.

16. The method according to claim 11, wherein said mailbox has a cross section area when assembled of at least 30 square inches.

17. The method according to claim 11, wherein said two planar sides, said planar base, said planar rear panel, said hinged planar front door, and said top are each formed of aluminum.

18. The method according to claim 11, wherein at least said two planar sides and planar base of said mailbox form a collapsible structure, which are collapsed when in said package, and wherein during assembly said planar rear panel is locked into place adjoining said planar base, said two planar sides, and said top, to provide sufficient rigidity of said two planar sides, said top, and said planar base to transform said collapsible structure into said mailbox.

* * * * *